US010945528B1

(12) United States Patent
Park

(10) Patent No.: US 10,945,528 B1
(45) Date of Patent: Mar. 16, 2021

(54) CHAIR SEAT BOARD AND CHAIR INCLUDING SAME

(71) Applicant: Chan Wook Park, Seoul (KR)

(72) Inventor: Chan Wook Park, Seoul (KR)

( * ) Notice: Subject to any disclaimer, the term of this patent is extended or adjusted under 35 U.S.C. 154(b) by 0 days.

(21) Appl. No.: 17/049,264

(22) PCT Filed: Jul. 22, 2019

(86) PCT No.: PCT/KR2019/009018
§ 371 (c)(1),
(2) Date: Oct. 20, 2020

(87) PCT Pub. No.: WO2020/027478
PCT Pub. Date: Feb. 6, 2020

(30) Foreign Application Priority Data

Jul. 30, 2018 (KR) ..... 10-2018-0088412

(51) Int. Cl.
*A47C 7/14* (2006.01)
*A47C 7/18* (2006.01)
*A47C 7/34* (2006.01)

(52) U.S. Cl.
CPC ..... *A47C 7/144* (2018.08); *A47C 7/185* (2013.01)

(58) Field of Classification Search
CPC ..... A47C 7/144; A47C 7/185
USPC ..... 297/219.1–229, 284.3, 312, 452.21, 297/452.23, 452.24, 452.25, 452.26, 297/452.48, 452.49
See application file for complete search history.

(56) References Cited

U.S. PATENT DOCUMENTS 2,482,996 A * 9/1949 Wisby ..... A47C 7/029 297/312
2,799,323 A * 7/1957 Berg ..... A47C 3/025 297/312
3,058,778 A * 10/1962 Campbell ..... A47C 3/0252 297/284.3 X
3,080,195 A * 3/1963 Berg ..... A47C 7/14 297/312
3,280,410 A * 10/1966 Propst ..... A47C 4/54 5/719 X
3,749,442 A * 7/1973 Berg ..... A47C 7/14 297/312

(Continued)

FOREIGN PATENT DOCUMENTS

CN 103889277 A 6/2014
DE 102006029085 A1 * 9/2007 ..... A47C 7/441

(Continued)

OTHER PUBLICATIONS

International Search Report for PCT/KR2019/009018 dated Oct. 30, 2019 (PCT/ISA/210).

(Continued)

*Primary Examiner* — Rodney B White
(74) *Attorney, Agent, or Firm* — Sughrue Mion, PLLC

(57) ABSTRACT

Disclosed is a chair seat board (100) and a chair (1000) to which a chair backboard (200) is coupled. The chair seat board (100) may comprise: a frame unit 40 having a plurality of frames (41, 42, 43, 44) configured in a hollow shape, respectively, and implemented to allow independent movement; and a support unit configured to support the frame unit 40 while being coupled to the frame unit (40) on a lower side of the frame unit (40).

9 Claims, 8 Drawing Sheets

(56) References Cited

U.S. PATENT DOCUMENTS 4,643,481 A * 2/1987 Saloff ..... A61G 5/1043 297/452.25
4,951,334 A * 8/1990 Maier ..... A61G 5/1043 297/452.21
5,024,485 A * 6/1991 Berg ..... A47C 3/025 297/312 X
5,088,747 A * 2/1992 Morrison ..... A61G 5/1043 297/219.1
5,286,089 A * 2/1994 Goldman ..... A47C 7/024 297/452.26
5,288,127 A * 2/1994 Berg ..... A47C 3/025 297/312 X
5,687,436 A * 11/1997 Denton ..... A47C 31/126 297/452.25 X
5,713,632 A * 2/1998 Su ..... A47C 7/024 297/312
5,913,568 A * 6/1999 Brightbill ..... A47C 3/025 297/312 X
6,079,782 A 6/2000 Berg et al.
6,082,824 A * 7/2000 Chow ..... A47C 9/002 297/452.56
6,142,573 A * 11/2000 Harding ..... A61G 5/1043 297/452.25
6,256,819 B1 * 7/2001 Maier ..... A47C 7/185 297/452.26
6,595,586 B2 * 7/2003 Brightbill ..... A47C 3/025 297/312
6,598,251 B2 * 7/2003 Habboub ..... B60N 2/242 297/452.42
6,625,830 B2 * 9/2003 Lampel ..... A47C 27/146 297/452.26
6,866,340 B1 * 3/2005 Robertshaw ..... A47C 7/024 297/312
6,990,744 B2 * 1/2006 Bieganek ..... A47C 7/021 33/515
7,140,057 B2 * 11/2006 Hetzel ..... A61G 5/1043 297/452.26 X
7,216,388 B2 * 5/2007 Bieganek ..... A61G 5/1043 297/452.26 X
7,373,678 B2 * 5/2008 Hetzel ..... A61G 5/1043 297/452.26 X
7,387,339 B2 * 6/2008 Bykov ..... A47C 7/14 297/312
7,614,704 B2 * 11/2009 Whelan ..... A47C 7/021 297/452.25
8,850,645 B1 * 10/2014 Jackson ..... A47C 4/52 297/452.23 X
9,021,637 B1 * 5/2015 Whelan ..... A61G 5/1045 297/452.25 X
9,462,890 B2 * 10/2016 Thomas ..... A47C 7/185
9,808,194 B2 * 11/2017 Bhat ..... A61B 5/1036
9,894,997 B2 * 2/2018 Thomas ..... A47C 7/021
10,194,754 B2 * 2/2019 Choi ..... G05B 15/02
10,448,744 B2 * 10/2019 Phillips ..... A47C 4/04
10,455,944 B2 * 10/2019 Chernin ..... A61G 5/124
10,610,021 B2 * 4/2020 Toland ..... A47C 7/347
2004/0245837 A1 * 12/2004 Clifford ..... A61G 5/1043 297/452.26
2021/0000259 A1 * 1/2021 Mascull ..... A47C 7/144

FOREIGN PATENT DOCUMENTS

DE 102007021486 A1 * 11/2008 ..... A47C 7/144
EP 93065 A * 11/1983 ..... A47C 27/144
FR 351735 A * 7/1905 ..... A47C 3/0252
FR 998840 A * 1/1952 ..... A47C 7/14
FR 1305406 A * 10/1962 ..... A47C 7/144
JP 06-175581 A 6/1994
JP 2012-061092 A 3/2012
KR 20-0256511 Y1 12/2001
KR 20-0419580 Y1 6/2006
KR 10-0702213 B1 4/2007
KR 10-2012-0045523 A 5/2012
KR 10-1384102 B1 4/2014

OTHER PUBLICATIONS

Notification of Reason for Refusal of Korean Application 10-2018-0088412 dated Mar. 9, 2020.
Korean Grant of Patent for KR 10-2018-0088412 dated Jul. 14, 2020.

* cited by examiner

CHAIR SEAT BOARD AND CHAIR INCLUDING SAME

CROSS REFERENCE TO RELATED APPLICATIONS

This application is a National Stage of International Application No. PCT/KR2019/009018, filed on Jul. 22, 2019, which claims priority from Korean Patent Application No. 10-2018-0088412, filed on Jul. 30 2018, the entire disclosures of which are incorporated herein by reference.

TECHNICAL FIELD

The present invention relates to a chair seat board and a chair comprising the same, and more specifically, is directed to a chair seat board that is ergonomically designed to minimize burden on the waist that may cause pain due to a gravity when a user is seated, and a chair comprising the same.

BACKGROUND OF THE INVENTION

In general, a chair has a structure whose seat board and backboard form a predetermined angle and whose legs are coupled to a lower side of the seat board, and the seat board and the backboard are provided with an outer shell having a cushion member such as a memory foam, an air cell and a sponge embedded therein.

If a user works in his/her fixed posture with the chair for a long time, the supply of blood and drugs to the intervertebral cartilage is blocked and the user's legs become stiff over time. Further, there is a problem in that if the user sits in the chair in an incorrect posture for a long time, a normal spine line cannot be formed so that kyphosis of the spine, which causes the back to bend toward the rear, occurs or pain occurs in the spine.

In order to solve these problems, a tilting seat board has been proposed in which the seat board moves obliquely according to the user's sitting posture, but the conventional seat board having such a tilting way has a disadvantage in that the configuration and connection relationship thereof are very complicated due to a large number of the constitutive elements.

Further, the tilting function provided in the conventional chair has been made for the user to lie down comfortably or to make the waist comfortable, but in reality, it causes an unreasonable waist angle due to the deformation of the body, which often results in fatal consequences for the waist health.

Therefore, the need for a seat board having an ergonomic structure that can maximize the user's satisfaction and a chair comprising the same is gradually increasing in the relevant art.

SUMMARY OF THE INVENTION

The present invention is conceived to solve the above problems, and a purpose of the present invention is to provide an ergonomic chair seat board, and a chair comprising the same, capable of providing an optimum angle of 125 degrees to 135 degrees to minimize burden on the waist that may cause pain due to a gravity when a user is seated.

Further, a purpose of the present invention is to provide an ergonomic chair seat board, and a chair comprising the same, capable of providing a comfort to the extent that a user does not feel any interference when seated, by combining omnidirectional movement of a central sphere in a recess and flexible movement of a plurality of frames relative to spring groups to realize independent movement of the plurality of frames.

Further, a purpose of the present invention is to provide an ergonomic chair seat board, and a chair comprising the same, capable of allowing a user's waist to take a neutral posture to prevent excessive bending of the waist, by implementing a tilt that is decreased toward a direction of the hips of the seat board in configuration of a support unit for supporting the plurality of frames realized to enable independent movement on a lower side thereof.

Further, a purpose of the present invention is to provide an ergonomic chair seat board, and a chair comprising the same, capable of maximizing a sciatic (sit-bone) balance and a weight distribution, by arranging a central plate in the area corresponding to the sciatic site and making a strength of the area corresponding to a user's sciatic site greater than that of the other areas in implementing a memory foam that covers the frames.

Furthermore, a purpose of the present invention is to provide a chair comprising an ergonomic backboard that has a waist plate deformed optimally according to a user's posture, by coupling the backboard to one side of the seat board and implementing to move it up and down depending on the user's sitting posture.

The technical problems of the present invention are not limited to those mentioned above, and the other technical problems that are not mentioned will be clearly understood by those skilled in the art from the following descriptions.

A chair seat board according to an embodiment of the present invention for solving the above technical problems may comprise: a frame unit having a plurality of frames configured in a hollow shape, respectively, and implemented to allow independent movement; and a support unit configured to support the frame unit while being coupled to the frame unit on a lower side of the frame unit.

Further, the support unit may preferably include a first support plate consisting of a first central support plate and side support plates disposed on both sides of the first central support plate; a second support plate coupled to an upper portion of the first support plate and consisting of a second central support plate and a limiting plate disposed on an upper surface of one side of the second central support plate; and a third support plate coupled to the upper portion of the second support plate and consisting of a plurality of leg support plates and a plurality of hip support plates formed to correspond to the plurality of frames.

Also, a thickness of the second central support plate may preferably be implemented to increase as it progresses from one side on which the limiting plate is arranged to the other side.

In addition, each of the plurality of leg support plates and the plurality of hip support plates may preferably be provided with recesses on at least some areas, and each of the plurality of frames may be provided with central plates having central spheres coupled to at least some areas of a lower surface.

Further, the central sphere coupled to the central plate may preferably be accommodated in the recess so that a coupling between the third support plate and the frame unit can be implemented.

Also, the plurality of leg support plates and the plurality of hip support plates may preferably be provided with a plurality of spring groups arranged to correspond to at least some areas of borders of the plurality of frames, and omnidirectional movement of the central sphere in the recess and flexible movement of the plurality of frames relative to the spring groups may be combined with each other to realize independent movement of the plurality of frames.

In addition, preferably, the chair seat board of the present invention may further comprise a memory foam configured to cover the frame unit coupled to the support unit.

Further, preferably, the memory foam may be composed of a plurality of leg memory foams and a plurality of hip memory foams configured to correspond to the plurality of leg support plates and the plurality of hip support plates, and the plurality of hip memory foams may be implemented such that a strength of the area corresponding to a sciatic (sit-bone) site is greater than that of the other areas.

More preferably, the plurality of leg memory foams may be implemented such that a strength of a front-end part thereof is less than that of the plurality of hip memory foams, and an end of the front-end part of the plurality of leg memory foams may be formed to bend downward.

Furthermore, a chair according to another embodiment of the present invention for solving the above technical problems may comprise the above-described chair seat board; and a chair backboard coupled to one side of the chair seat board.

Effect of the Invention

A chair seat board and a chair comprising the same according to an embodiment of the present invention can provide an optimum angle of 125 degrees to 135 degrees to minimize burden on the waist that may cause pain due to a gravity when a user is seated.

Further, a chair seat board and a chair comprising the same according to an embodiment of the present invention can provide a comfort to the extent that a user does not feel any interference when seated, by combining omnidirectional movement of a central sphere in a recess and flexible movement of a plurality of frames relative to spring groups to realize independent movement of the plurality of frames.

Further, a chair seat board and a chair comprising the same according to an embodiment of the present invention can allow a user's waist to take a neutral posture to prevent excessive bending of the waist, by implementing a tilt that decreases toward a direction of the hips of the seat board in configuration of a support unit for supporting the plurality of frames realized to allow independent movement on a lower side thereof.

Further, a chair seat board and a chair comprising the same according to an embodiment of the present invention can maximize a sciatic balance and a weight distribution by arranging a central plate in the area corresponding to the sciatic site and making a strength of the area corresponding to a user's sciatic site greater than that of the other areas in implementing a memory foam that covers the frames.

Furthermore, a chair comprising an ergonomic backboard according to an embodiment of the present invention can deform a waist plate according to a user's posture ergonomically and optimally, by coupling the backboard to one side of the seat board and implementing to move it up and down and left and right depending on the user's sitting posture.

BRIEF DESCRIPTION OF THE DRAWINGS

Brief description of each drawing is provided in order to more fully understand the drawings cited in the detailed description of the present invention.

DETAILED DESCRIPTION OF THE INVENTION

Figure 1:
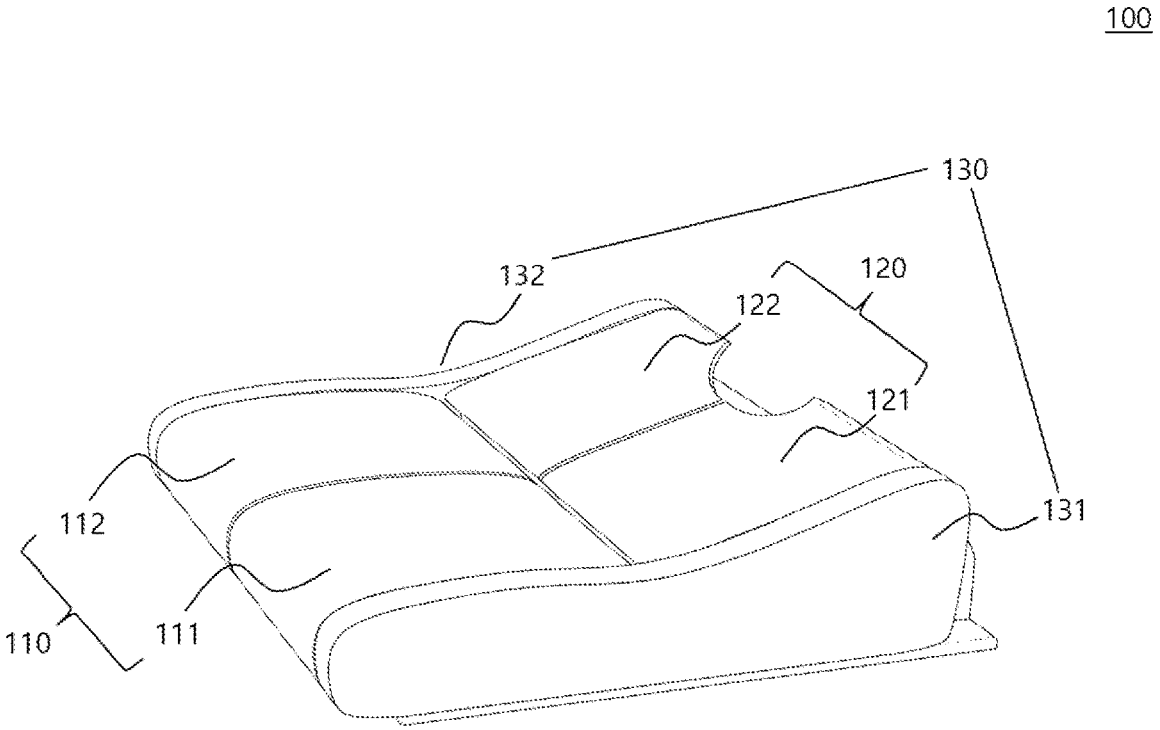
FIG. 1 is a schematic perspective view of a chair seat board according to an embodiment of the present invention.

Hereinafter, embodiments according to the present invention will be described with reference to the accompanying drawings. It should be noted that reference numerals for constitutive elements in each of the drawings are denoted by the same reference numerals as possible, if the same constitutive elements are mentioned on different drawings. In addition, in case it is considered that a detailed description of a related known constitution or function is obstructed in explaining an embodiment of the present invention, the detailed description thereof will be omitted from the specification. Further, embodiments of the present invention will be described below, but the technical idea of the present invention may be variously modified and implemented by those skilled in the art without being defined or limited thereto.

Throughout the specification, if a certain portion is said to be "connected" to the other portion, this refers to not only "directly connected" but also "indirectly connected" with another portion interposed there-between. Throughout the specification, if a certain portion is said to "includes" a certain constitutive element, it means that the other constitutive element may be further included in the certain portion rather than excluding the other constitutive element unless otherwise stated. In addition, the embodiments of the present invention may include the terms such as first, second, A, B, (a), (b), and the like, in order to specify the constitutive elements. These terms are merely used to distinguish the constitutive elements from the other constitutive elements, and natures or orders of the constitutive elements are not limited by the terms.

Figure 2:
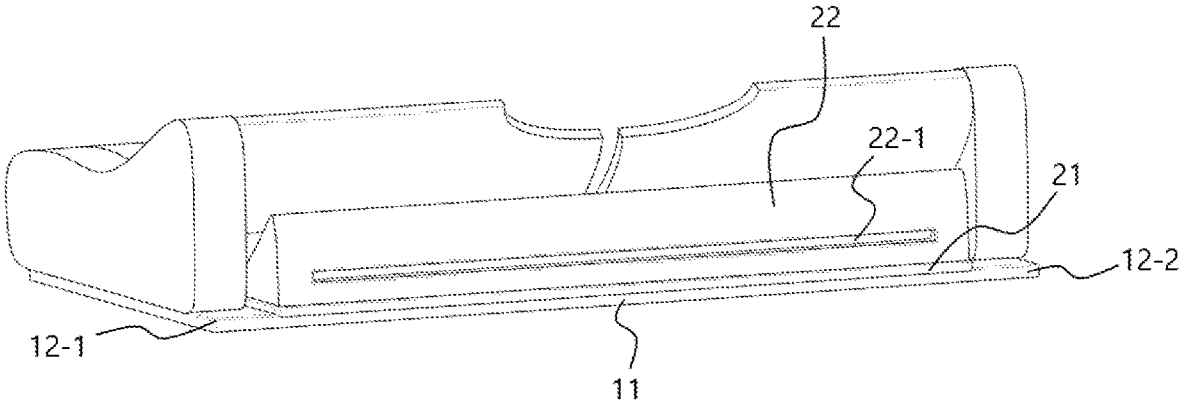
FIG. 2 is a rear perspective view of a chair seat board according to an embodiment of the present invention.
Figure 3:
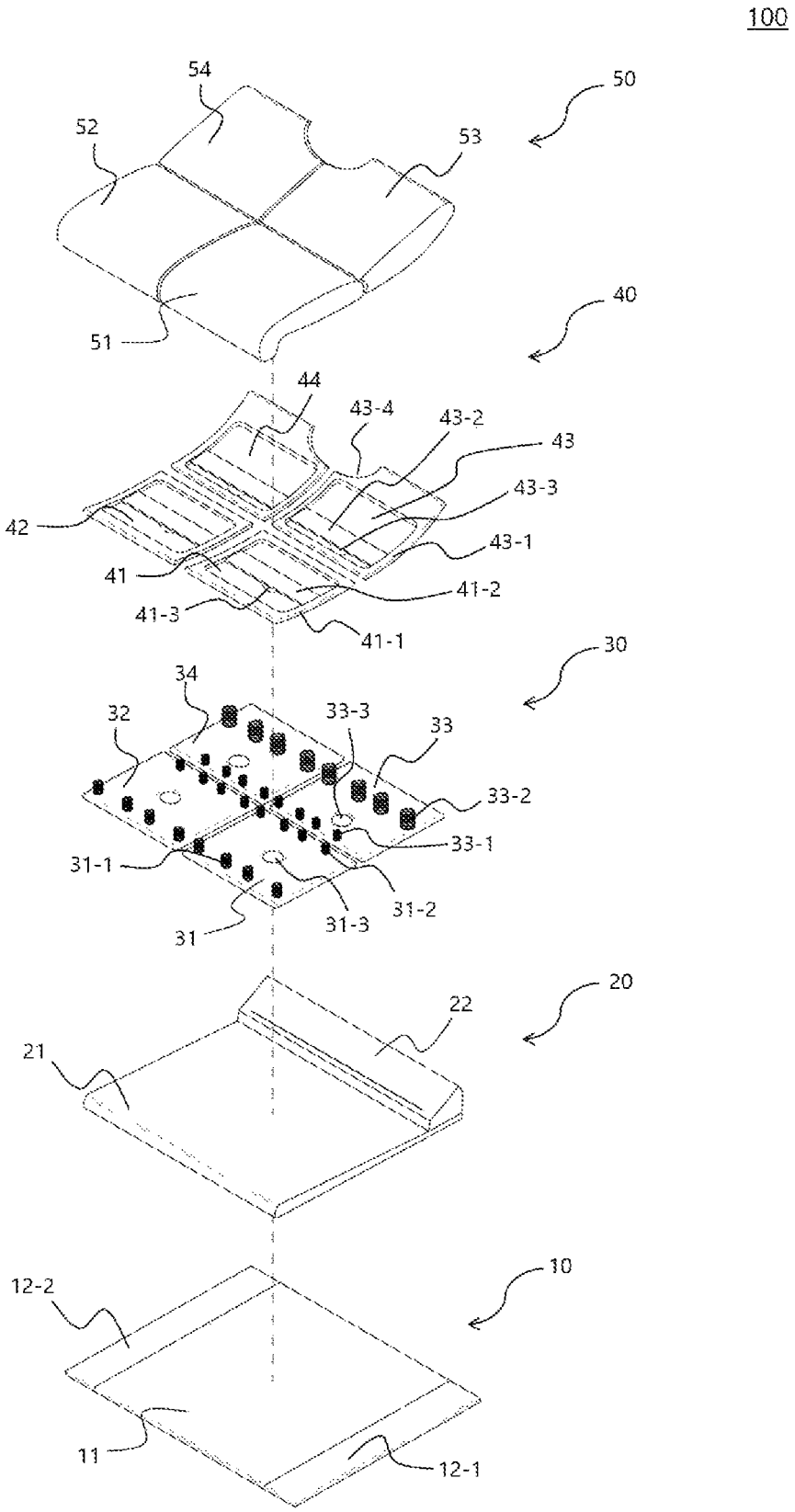
FIG. 3 is an exploded perspective view of a chair seat board according to an embodiment of the present invention.

FIG. 1 is a schematic perspective view of a chair seat board 100 according to an embodiment of the present invention, and FIG. 2 is a rear perspective view of a chair seat board 100 according to an embodiment of the present invention. For reference, FIGS. 1 and 2 show the chair seat board 100 having a predetermined memory foam covered thereon, and FIG. 3 illustrates a detailed internal constitution of the chair seat board from which the memory foam is removed, as will be described in more detail below.

For reference, as a material that covers an external surface of the chair seat board 100 according to an embodiment of the present invention, the memory foam or an air cell may be adopted, or a bonding material created by combining another new material with the memory foam may be adopted. The adoption of the memory foam will be exemplarily described in the following specification, but it is emphasized that the present invention is not limited only to the application of the memory foam.

As shown in FIGS. 1 and 2, the chair seat board 100 according to an embodiment of the present invention may comprise a pair of leg seat boards 110 and a pair of hip seat boards 120.

The pair of leg seat boards 110 may include a first leg seat board 111 that is in contact with a user's left leg, more specifically a user's left thigh, and a second leg seat board 112 that is in contact with a user's right leg, more specifically a user's right thigh. Similarly, the pair of hip seat boards 120 may include a first hip seat board 121 that is in contact with a user's left hip and a second hip seat board 122 that is in contact with a user's right hip.

In addition, according to a further embodiment of the present invention, the chair seat board 100 may optionally further comprise a pair of side seat boards 130 covering the pair of leg seat boards 110 and the pair of hip seat boards 120 on a side surface of the chair seat board 100. In other words, it is also possible to configure the chair seat board 100 without arranging the pair of side seat boards 130 that cover the pair of leg seat boards 110 and the pair of hip seat boards 120 on the side surface.

As shown in FIG. 1, the pair of side seat boards 130 may include a first side seat board 131 at the left based on the user's sitting posture and/or a second side seat board 132 at the right based on the user's sitting posture. In this regard, in contrast to the pair of leg seat boards 110 and the pair of hip seat boards 120 where the structures such as the frame unit and the support plates are arranged inside the memory foam, the pair of side seat boards 130 may be only composed of the memory foam without having these structures arranged therein.

For reference, as shown in FIG. 2, the pair of side seat boards 130 may be combined to a first side support plate 12-1 and a second side support plate 12-2 of a first support plate 10 (see FIG. 3), respectively. In addition, in the coupled chair seat board 100, a limiting plate 22 implemented such that a user can maintain a predetermined angle in a certain area may be disposed at a lower end of one side of the pair of hip seat boards 120. The limiting plate 22 may also be disposed on an upper surface of one side of the second central support plate 21 that is arranged on the upper surface of the first central support plate 11.

For reference, a rectangular groove 22-1 may be additionally formed on one surface of the limiting plate 22 shown in FIG. 2, and the chair backboard 200 (see FIG. 5) to be described later can be coupled with the chair seat board 100 through the rectangular groove 22-1. This coupling way will be described in more detail below.

The chair seat board 100 according to an exemplary embodiment of the present invention illustrated in FIGS. 1 and 2 allows a user to take the most comfortable and natural posture unconsciously when seated. It has been found through many studies that, in order to minimize the burden on the waist site that may cause pain due to a gravity when the user is seated, the angle leading to the user's upper body (waist), hips and legs (that is, the angle formed by an inner side of the body around a navel or a pelvis when seated in the chair) is preferably maintained at 125 degrees to 135 degrees. However, even though many chair manufactures have proposed various chair structures to derive this angle, they still have problems such as failing to use the backrest or causing pain of a knee. Accordingly, the present invention proposes a chair seat board 100, and a chair 1000 (see FIG. 8) comprising the same, that can provide an optimal angle to the user without causing these problems, and a detailed structure of the chair seat board 100 for this purpose is shown in FIG. 3.

FIG. 3 is an exploded perspective view of a chair seat board 100 according to an embodiment of the present invention. As shown in FIG. 3, the chair seat board 100 according to an embodiment of the present invention may comprise a first support plate 10, a second support plate 20, a third support plate 30, a frame unit 40, and a memory foam 50. For reference, although not explicitly shown in FIG. 3, a pair of side seat boards 130 may be optionally further arranged on upper surfaces of the first side support plate 12-1 and the second side support plate 12-2 of the first support plate 10.

Further, the first support plate 10, the second support plate 20 and the third support plate 30 are configured to support the frame unit 40 from a lower side of the frame unit 40 by mutual coupling between them, and thus these three elements (10, 20, 30) including the first support plate 10, the second support plate 20 and the third support plate 30 will be collectively referred to as a 'support unit' in the following specification. Accordingly, the frame unit 40 according to an embodiment of the present invention is coupled with the support unit at the lower side to be supported by the support unit, and is covered at the upper side by the memory foam 50. Optionally, a side surface of the frame unit 40 may be arranged with a pair of side seat boards 130 to configure the chair seat board 100. Hereinafter, each of the constitutive elements configuring the chair seat board 100 according to an embodiment of the present invention will be described in more detail.

As described above, the support unit that is coupled to the frame unit 40 from the lower side of the frame unit 40 and supports the frame unit 40 can be implemented in a three-layer structure of the first support plate 10, the second support plate 20 and the third support plate 30. Among them, a detailed configuration of the lowermost first support plate 10 is shown at the bottom of FIG. 3.

The first support plate 10 may include a first central support plate 11, and a first side support plate 12-1 and a second side support plate 12-2 disposed on both sides of the first central support plate 11. A second central support plate 21 of the second support plate 20 to be described later may be disposed on an upper surface of the first central support plate 11, and thus a width of the first central support plate 11 may be substantially the same as that of the second central support plate 21.

Further, the first and second side support plates (12-1, 12-2) disposed on both sides of the first central support plate 11 may be arranged with a first side seat board 131 and a second side seat board 132. A width of the first and second side support plates (12-1, 12-2) may be, for example, about 3 cm.

The second support plate 20 may be coupled to an upper portion of the first support plate 10. More specifically, as shown in FIG. 3, the second support plate 20 according to an embodiment of the present invention may include a second central support plate 21 and a limiting plate 22 disposed on an upper surface of one side of the second central support plate 21. A threshold value at which first and second hip frames (43, 44) descend can be set through the limiting plate 22 disposed on the upper surface of one side of the second central support plate 21, whereby the same stable angle (for example, 125 degrees to 135 degrees) regardless of the user's weight can be provided to the user. This structure and function will be described in more detail in FIGS. 4*a* to 4*b* below.

In particular, as shown in FIG. 2, the second central support plate 21 according to an embodiment of the present invention may be implemented to increase in thickness as it progresses from one side on which the limiting plate 22 is disposed to the other side. In other words, the second central support plate 21 may be implemented in a tilted shape such that a thickness toward a direction of the leg is greater than that toward a direction of the hips, wherein the tilted angle of the second central support plate 21 may have any value within the range of about 2 degrees to about 8 degrees.

The third support plate 30 is coupled to an upper portion of the second support plate 20, and may be composed of a plurality of leg support plates (31, 32) and a plurality of hip support plates (33, 34) that are formed to correspond to a plurality of frames (41, 42, 43, 44) as will be described later.

The plurality of leg support plates (31, 32) may be composed of a left leg, more specifically a left leg support plate 31 supporting a thigh of the left leg, when the user is seated, and a right leg, more specifically a right leg support plate 32 supporting a thigh of the right leg, when the user is seated. Herein, a length of the plurality of leg support plates (31, 32) may be implemented relatively shorter than leg support portions of a general chair, thereby securing a ham spring space so that the user's blood circulation can be promoted and pain can be prevented. Similarly, the plurality of hip support plates (33, 34) may include a left hip support plate 33 configured to support the user's left hip and a right hip support plate 34 configured to support the user's right hip.

Further, each of the plurality of leg support plates (31, 32) and the plurality of hip support plates (33, 34) is provided with recesses (31-3, 33-3) in at least some areas thereof, wherein the recesses (31-3, 33-3) may be utilized for coupling with the central plates (41-2, 43-2) provided at each of the plurality of frames (41, 42, 43, 44). A more detailed description of this coupling structure will be described again with reference to FIGS. 4*a* to 4*c* below.

In addition, as shown in FIG. 3, the plurality of leg support plates (31, 32) and the plurality of hip support plates (33, 34) may be provided with a plurality of spring groups (31-1, 31-2, 33-1, 33-2) arranged corresponding to at least some areas of borders of the plurality of frames (41, 42, 43, 44). More specifically, the plurality of spring groups (31-1, 31-2, 33-1, 33-2) may include a first spring group 31-1 disposed in a front edge area of the left leg support plate 31, a second spring group 31-2 disposed in a rear edge area of the left leg support plate 31, a third spring group 33-1 disposed in a front edge area of the left hip support plate 33, and a fourth spring group 33-2 disposed in a rear edge area of the left hip support plate 33. For reference, as explicitly shown in FIG. 3, such spring groups may also be disposed in the same or similar manner to the right leg support plate 32 and the right hip support plate 34, but the specification as specified below will explain only the left leg and hip support plates for the sake of easy understanding of the present invention.

The plurality of spring groups (31-1, 31-2, 33-1, 33-2) can not only disperses the user's weight, but also function organically together with first and second central spheres (41-3, 43-3) engaged with and coupled to first and second recesses (31-3, 33-3) so as to allow flexible change of the plurality of frames (41, 42, 43, 44) according to the user's various postures. For example, the number, thickness, length, size, etc. of the plurality of spring groups (31-1, 31-2, 33-1, 33-2) may be differently implemented depending on the position at which they are arranged. For example, as shown in FIG. 3, the thickness and length of the fourth spring group 33-2 for dispersing a weight behind the hip may be implemented to be greater than those of the other spring groups (31-1, 31-2, 33-1).

Meanwhile, independent movement of the plurality of frames (41, 42, 43, 44) can be implemented by combination of omnidirectional movement of the central spheres (41-3, 43-3) through the recesses (31-3, 33-3) and flexible movement of the plurality of frames (41, 42, 43, 44) relative to the spring groups (31-1, 31-2, 33-1, 33-2), which will be described in detail with reference to FIGS. 4*a* to 4*c* below.

The frame unit 40 may be composed of the plurality of frames (41, 42, 43, 44), each of which is configured in a hollow shape and implemented to allow independent movement. More specifically, the plurality of frames (41, 42, 43, 44) may include a first leg frame 41 corresponding to the user's left leg, that is, the left thigh area, a second leg frame 42 corresponding to the user's right leg, that is, the right thigh area, a first hip frame 43 corresponding to the user's left hip area, and a second hip frame 44 corresponding to the user's right hip area.

Further, as shown in FIG. 3, the first leg frame 41 is coupled to the left leg support plate 31 on a lower side thereof and covered by a first leg memory foam 51 on an upper side thereof. The second leg frame 42 is coupled to the right leg support plate 32 on a lower side thereof and covered by a second leg memory foam 52 on an upper side thereof. The first hip frame 43 is coupled to the left hip support plate 33 on a lower side thereof and covered by a first hip memory foam 53 on an upper side thereof. The second hip frame 44 is coupled to the right hip support plate 34 on a lower side thereof and covered by a second hip memory foam 54 on an upper side thereof.

Further, since a cutout portion 43-4 of a semicircular shape is provided in one area of borders (41-1, 43-1) of the hip frames (43, 44) and an another cutout portion (for example, the cutout portion of the semicircular shape with a diameter of about 5 cm) corresponding thereto is also provided in a memory foam 50 covered on an upper portion of the frame 40, that is, in the hip memory foams (53, 54), the user can feel more comfortable in the center of the hip when seated. In other words, a coccyx pain can be prevented in advance by alleviating burden of a load on the tailbone that is applied when the user is seated on the chair seat board 100 according to an embodiment of the present invention.

Further, as shown in FIG. 3, the plurality of frames (41, 42, 43, 44) may be arranged to be spaced apart from each other by a predetermined interval (for example, they may be spaced apart from each other by about 2 cm), which can become a structural basis that enables independent movement of each frame without interfering between the adjacent frames.

Herein, each of the plurality of frames (41, 42, 43, 44) may be arranged with a plate-shaped central plates (41-2, 43-2) extending from one side of the frame borders (41-1, 43-1) to the other side thereof, and the central spheres (41-3, 43-3) may be formed in at least some areas of a lower surface of the central plates (41-2, 43-2). The central spheres (41-3, 43-3) coupled to the central plates (41-2, 43-2) are accommodated into the third support plate 30, that is, into the recesses (31-3, 33-3) provided in the left leg support plate 31, the right leg support plate 32, the left hip support plate 33 and the right hip support plate 34, so that the third support plate 30 can be coupled with the frame unit 40. In particular, the omnidirectional movement of the central spheres (41-3, 43-3) within the recesses (31-3, 33-3) and the flexible movement of the plurality of frames (41, 42, 43, 44) relative to the spring groups (31-1, 31-2, 33-1, 33-2) are combined with each other so that the independent movement of the plurality of frames (41, 42, 43, 44) can be achieved.

Further, since each of the plurality of frames (41, 42, 43, 44) is implemented in a hollow shape, one central sphere (41-3 or 43-3) may be provided only in one frame, and the spring groups (31-1, 31-2, 33-1, 33-2) may be properly arranged in the area on which the frames (41, 42, 43, 44) are tilted.

As described above, in addition to the frames (41, 42, 43, 44) of the hollow shape, the chair seat board 100 according to an embodiment of the present invention allows the user to freely change various postures at any time, such as a forward leaning posture, a normal posture, and a backward leaning posture, when seated on the chair seat board 100, by combining the engagement coupling (i.e., omnidirectional movement) of the central spheres (41-3, 43-3) and the recesses (31-1, 33-1), with the flexible movement of the plurality of frames (41, 42, 43, 44) relative to the spring groups (31-1, 31-2, 33-1, 33-2). For reference, in order to specify the adaptive movement of the frame unit 40 according to the user's posture change, the three postures of the forward leaning posture, the normal posture and the backward leaning posture will be exemplarily described in the present specification below. However, it will be apparent that additional postures other than the three postures described above can be implemented depending on the degree of the user's front and rear tilt and the degree of the user's left and right tilt.

Based on the chair seat board 100 shown in FIG. 3, the configuration that enables a change to various postures without interference or consciousness to the user will be described with reference to FIGS. 4*a* to 4*c* below.

Figure 4A:
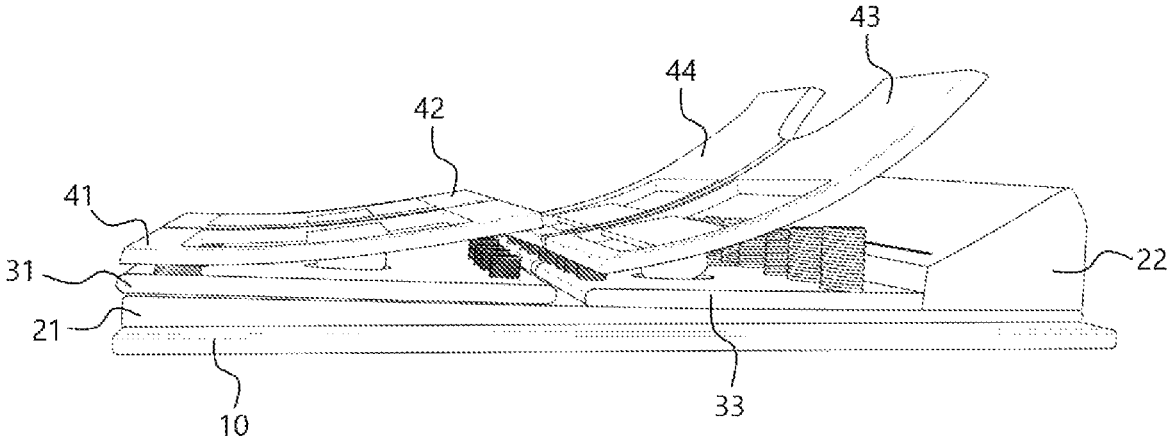
FIGS. 4*a* to 4*c* are conceptual diagrams illustrating a chair seat board that changes its shape flexibly depending on a user's sitting posture.
Figure 4B:
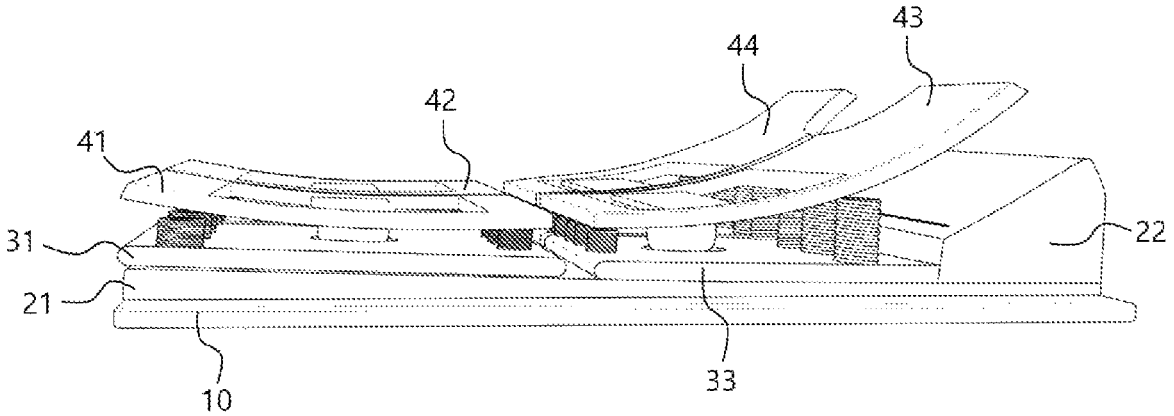
Figure 4C:
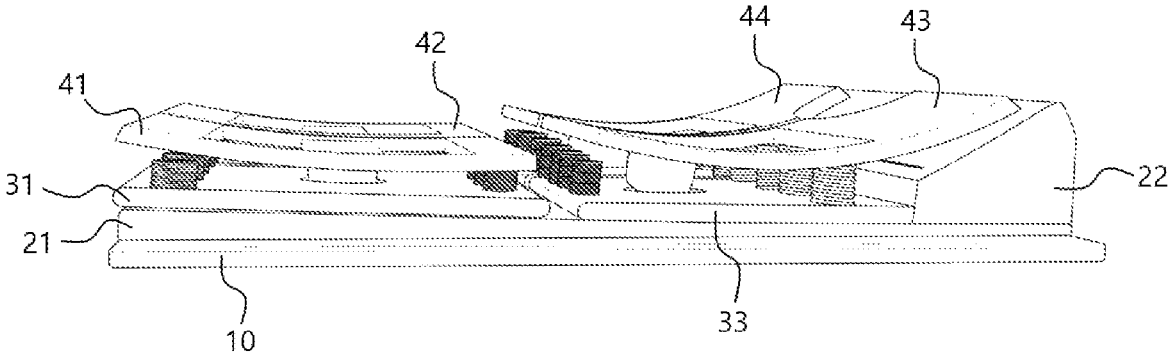

FIGS. 4*a* to 4*c* are conceptual diagrams for explaining a chair seat board 100 that can change its shape flexibly according to a user's sitting posture.

FIG. 4*a* shows a change in the shape of the frames (41, 42, 43, 44) when the user takes the forward leaning posture. When the user takes a posture leaned toward the front, both the leg frames (41, 42) and the hip frames (43, 44) are tilted toward the front. Such a tilting (deformation) can be made by the omnidirectional movement of the central spheres (41-3, 43-3) in the recesses (31-3, 33-3) with the plurality of spring groups (31-1, 31-2, 33-1, 33-2).

Herein, as explicitly shown in FIG. 3 and FIG. 4*a*, the second central support plate 21 is implemented to increase in thickness as it progresses from one side on which the limiting plate 22 is arranged to the other side. Since the third support plate 30, the frame unit 40 and the memory foam 50 are sequentially stacked and combined on an upper portion of the second central support plate 21, the chair seat board 100 according to an embodiment of the present invention has a shape tilted toward the hips by a predetermined angle (for example, 2 degrees to 8 degrees). In this way, due to the structure in which the chair seat board 100 is titled downward toward the hips rather than a flat shape, the user's waist can be maintained in a neutral posture, and even if the user takes any posture, the chair seat board 100 can maintain a constant angle of 125 degrees to 135 degrees as aforementioned.

Further, FIG. 4*b* shows a change in the shape of the frames (41, 42, 43, 44) when the user takes the normal posture. When the user takes the neutral posture that is neither inclined toward the front nor inclined toward the rear, both the leg frames (41, 42) and the hip frames (43, 44) can be maintained in a flat shape around the central spheres (41-3, 43-3).

Further, FIG. 4*c* shows a change in the shape of the frames (41, 42, 43, 44) when the user takes the backward leaning posture (i.e., when the center of the weight is toward the rear). In case the user takes a posture that is inclined toward the rear, the leg frames (41, 42) are maintained in the flat shape around the central sphere 41-3 or are tilted toward the front only to a slight extent, whereas the hip frames (43 44) are tilted toward the rear. This deformation can be made by the omnidirectional movement of the central spheres (41-3, 43-3) in the recesses (31-3, 33-3) with the plurality of spring groups (31-1, 31-2, 33-1, 33-2).

Herein, in order to provide the user with an optimum angle (e.g., 125 degrees to 135 degrees), it is preferable to set a threshold value at which the hip frames (43, 44) go down. According to an embodiment of the present invention, the threshold value at which the hip frames (43, 44) descend can be set by the limiting plate 22. As shown in FIG. 4*c*, when the user takes the backward leaning posture, the limiting plate 22 restricts a degree to which the hip frames (43, 44) descend so that the chair seat board 100 can move within a predetermined angle (for example, 125 degrees to 135 degrees), thereby providing more comfort to the user. Further, in the backward leaning posture at which the user puts the center of the weight back, the frame goes down simultaneously with the spring groups being pressed down, and thus it is possible to provide a posture that allows the user to comfortably lean his/her own back while maintaining the required angle, thereby overcoming the deformation problem due to the difference in the weight of the user.

Further, as described in connection with FIGS. 4*a* to 4*c*, in addition to the frames (41, 42, 43, 44) of the hollow shape, the chair seat board 100 according to an embodiment of the present invention allows the user to freely change various postures at any time, such as the forward leaning posture, the normal posture, and the backward leaning posture, when seated on the chair seat board 100, by combining the engagement coupling (i.e., omnidirectional movement) of the central spheres (41-3, 43-3) and the recesses (31-1, 33-1), with the flexible movement of the plurality of frames (41, 42, 43, 44) relative to the spring groups (31-1, 31-2, 33-1, 33-2). The central spheres (41-3, 43-3) plays a major role for changing the movement type of the frames (41, 42, 43, 44).

More specifically, the central spheres (41-3, 43-3) can have a complete sphere shape that not only assists the movement of the frames (41, 42, 43, 44) when the user moves back and forth or left and right, but also assists the user to twist the upper body as well as the pelvis when the user moves left or right or when the body is tilted. By implementing the central spheres (41-3, 43-3) in the form of the complete sphere shape, it is possible to change the movement type in a direction desired by the user through a combination with the spring. In addition, the chair seat board 100 implements the movement of the frames (41, 42, 43, 44) inside the central portion while the memory foam 50 is covered, so that the user cannot visually see a twisted shape of the chair. In addition, an angle change of the hip frames (43, 44) is greater than that of the leg frames (41, 42), and thus, according to another embodiment of the present invention, the second central sphere 43-3 provided on the hip frames (43, 44) side can be implemented to have a larger length and/or width than those of the first central sphere 41-3 provided on the leg frames (41, 42) side.

Further, the plate-shaped central plates (41-2, 43-2) are arranged from one side of each frame (41, 42, 43, 44) to the other side thereof, wherein these central plates (41-2, 43-2) serve to fix the sciatic (sit-bone) position. For example, the first central plate 41-2 may be provided at a predetermined position (e.g., a point of about 6:4 from the front) of the leg frames (41, 42), and the second central plate 43-2 may be provided at a predetermined position (e.g., a point of about 3:7 from the front) of the hip frames (43, 44). These ratios (i.e., "6:4", "3:7", etc.) with respect to the arrangement position of the central plates (41-2, 43-2) within the frames (41, 42, 43, 44) of the hollow shape were derived as the values that provides optimal comfort and stability to the user through a number of studies and investigations by the present inventor. Accordingly, the independent movement of the frames (41, 42, 43, 44) according to various postures of the user can be further assisted by selecting the appropriate arrangement of the central plates (41-2, 43-2).

In particular, the second central plate 43-2 provided on the hip frames (43, 44) may be disposed in an area corresponding to the user's sciatic position. In addition, the hip memory foams (53, 54) covered on the upper surface of the hip frames (43, 44) may be implemented such that a strength of the area corresponding to the sciatic position is greater than that of other area, whereby it is possible to prevent a phenomenon that the overall balance of the upper body is twisted while the sit-bone is disturbed. For reference, the leg memory foams (51, 52) may be implemented such that a strength of the front-end part thereof is less than that of the hip memory foams (53, 54). In particular, as the front-end part of the leg memory foams (51, 52) is covered toward the front beyond the leg frames (41, 42) by forming the front-end part in a shape bent downward (for example, a shape like a bird's beak) (for example, see FIG. 3), it is possible to prevent the limitation of the thigh angle due to the frame as well as to visually shield the leg frames (41, 42) in terms of the design.

For reference, FIGS. 1 to 3 exemplarily show a chair seat board 100 covered with a memory foam 50, but in fact, the chair seat board 100 according to the present invention can be additionally applied with a material such as a fabric and a leather on the memory foam 50, and thus, the independent movement of the frames (41, 42, 43, 44) as described above is implemented only inside the chair seat board 100 so that the user does not see the independent movement visually from the outside at all.

Further, the plurality of frames (41, 42, 43, 44), each of which is configured to independently move according to the user's motion, have been described in the above, but according to a further embodiment of the present invention, the chair seat board 100 itself may be implemented such that it moves back and forth. For example, if an outer frame in which a rectangular rolling section is formed in the front and rear direction is additionally installed on a side surface of the chair seat board 100 and a rolling plate that can move within the formed rolling section is coupled, it is possible to move the chair seat board 100 back and forth. Alternatively, if a rolling line is formed in the front and rear direction at least one area of the second central support plate 21 and a predetermined rolling plate is installed on a lower side of the plurality of support plates (31, 32, 33, 34), it is also possible to move the chair seat board 100 back and forth. Therefore, the chair seat board 100 can be moved back and forth around the user's weight. A chair backboard 200 to be described later can securely hold the waist according to the seesaw principle, thereby providing an ergonomic tilting function to the user.

Figure 5:
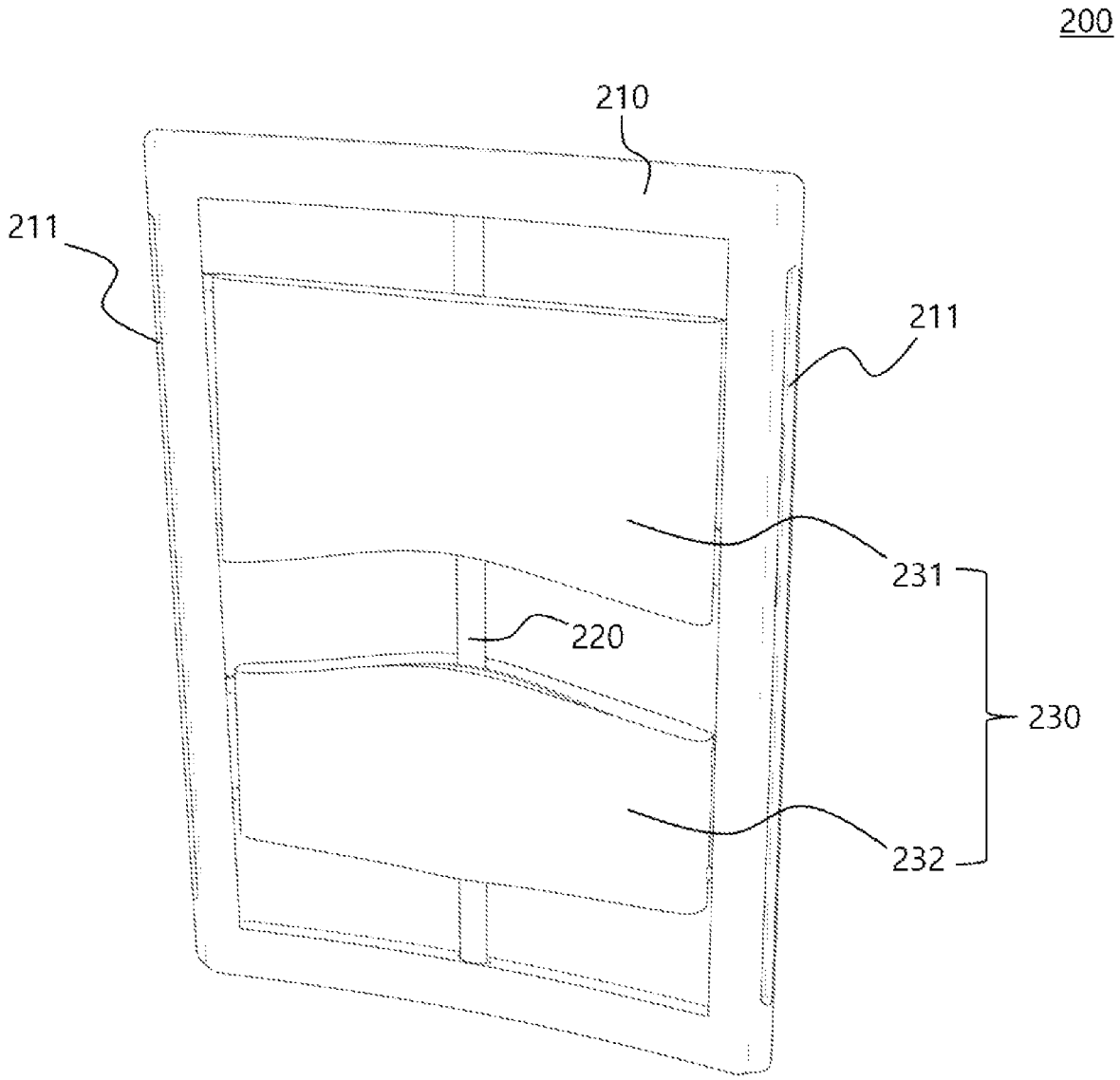
FIG. 5 is a schematic perspective view of a chair backboard according to an embodiment of the present invention.
Figure 6A:
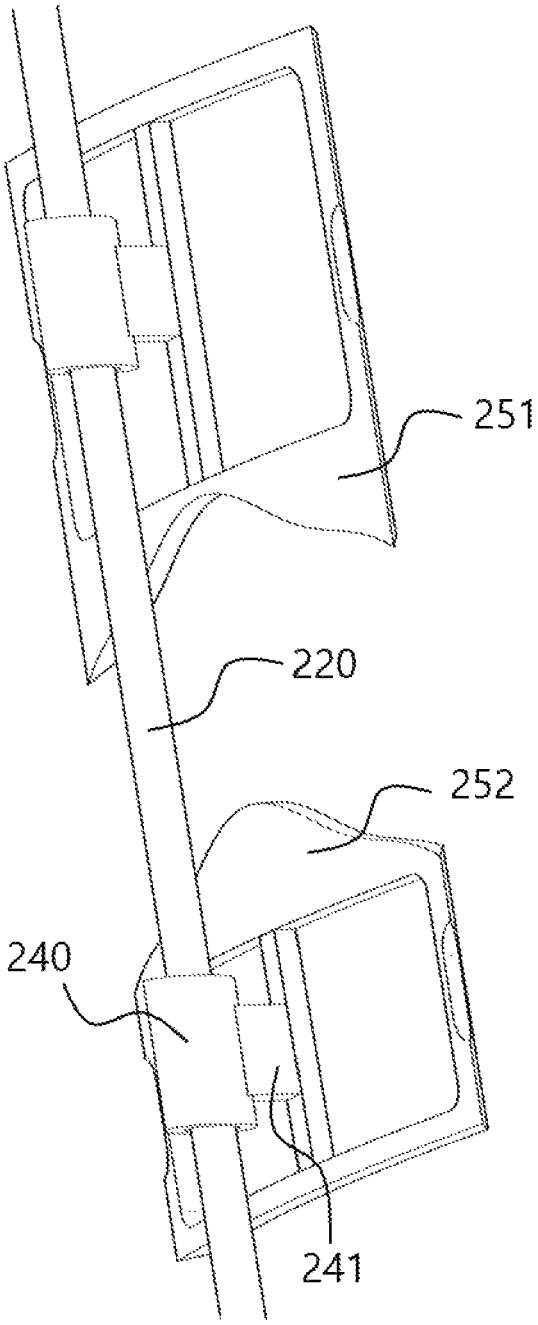
FIG. 6*a* is a perspective view for explaining operation of a rotation axis and a central plate of the chair backboard shown in FIG. 5.

FIG. 5 is a schematic perspective view showing an outer frame of a chair backboard 200 according to an embodiment of the present invention, and FIG. 6*a* is a perspective view for explaining operations of a pole 220, a third central plate 240 and a rotation axis 241 of the chair backboard 200 shown in FIG. 5.

The chair backboard 200 according to an embodiment of the present invention may comprise a border frame 210 having a shape curved at a predetermined angle, a pole 220 extending from the center of an upper edge of the border frame 210 to the center of a lower edge of the border frame 210, an upper backboard frame 251 and a lower backboard frame 252 that are rotationally coupled to at least one area of the pole 220 through a rotation axis 241 and a third central plate 240, and the third central plate 240 configured to couple the backboard frames (251, 252) to the pole 220.

Like the plurality (for example, four) of frames (41, 42, 43, 44), each of which is configured in the hollow shape and implemented to allow the independent movement, the chair backboard 200 according to an embodiment of the present invention is provided with a plurality (for example, two) of backboard frames (251, 252), each of which is implemented in a hollow shape and implemented to allow the independent movement. Such upper and lower backboard frames (251, 252) are implemented to enable up and down or left and right movement.

Further, each of the upper and lower backboard frames (251, 252) may be covered with a backboard memory foam 230 composed of an upper backboard memory foam 231 and a lower backboard memory foam 232, and the chair backboard 200 covered with the backboard memory foam 230 on one side of the backboard frames (251, 252) is shown in FIG. 5. Accordingly, since the movement of the backboard frames (251, 252) is implemented only therein, the user cannot visually recognize the movement of the backboard frames (251, 252).

Herein, according to a further embodiment of the present invention, the upper backboard memory foam 231 and the lower backboard memory foam 232 may be implemented to be convex in a middle area thereof so that the backboard memory foam 230 can reach the user's waist bone when the user is seated. Each of the upper backboard memory foam 231 and the lower backboard memory foam 232 may make the middle areas thereof convex to contact the user's waist bone, thereby increasing the area in contact with the user's body to minimize elasticity applied to the body. In addition, a degree of bending of the upper backboard memory foam 231 may be implemented to be greater than that of the lower backboard memory foam 232, whereby the user's chest is widened when the user is seated to make breathing more comfortable and to provide a comfortable posture. Also, the upper backboard memory foam 231 and the lower backboard memory foam 232 may have different strengths depending on their position, and may be, for example, implemented such that a strength of the central area corresponding to the user's waist bone and the end area on both sides is higher than the strength of the other area.

Further, the pole 220 formed to extend from the center of the upper edge of the border frame 210 to the center of the lower edge thereof serves to move the chair as well when the user moves only the upper body while the chair is fixed. Unlike the other chair products that move the backboard itself, the chair backboard 200 according to the present invention has a characteristic that the user cannot visually see the movement of the upper backboard frame 251 and the lower backboard frame 252 because they move only inside the chair backboard 200. In addition, the third central plates 240, each of which is coupled to one area of the pole 220, are implemented to move up and down around the pole 220 when they are customized to fit a height of the user. Both side surfaces of the border frame 210 are formed with side holes 211 so that the user can adjust a height of the upper backboard frame 251 and/or the lower backboard frame 252 through the side holes 211.

Further, in addition to adjusting the position of the backboard frames (251, 252) through the side holes 211, a rear surface of the chair backboard 200 may be opened according to a further embodiment of the present invention, and thus it is also possible to adjust a height of the upper backboard frame 251 and/or the lower backboard frame 252 while the rear surface of the chair backboard 200 is open.

Further, a predetermined groove is formed in the third central plate 240 that moves up and down around the pole 220, and the rotation axis 241 is rotationally coupled through the formed groove. Accordingly, the left and right movement of the backboard frames (251, 252) that are fixedly coupled to the rotation axis 241 according to the user's left and right movement can be performed by the left and right movement of the rotation axis 241.

Figure 6B:
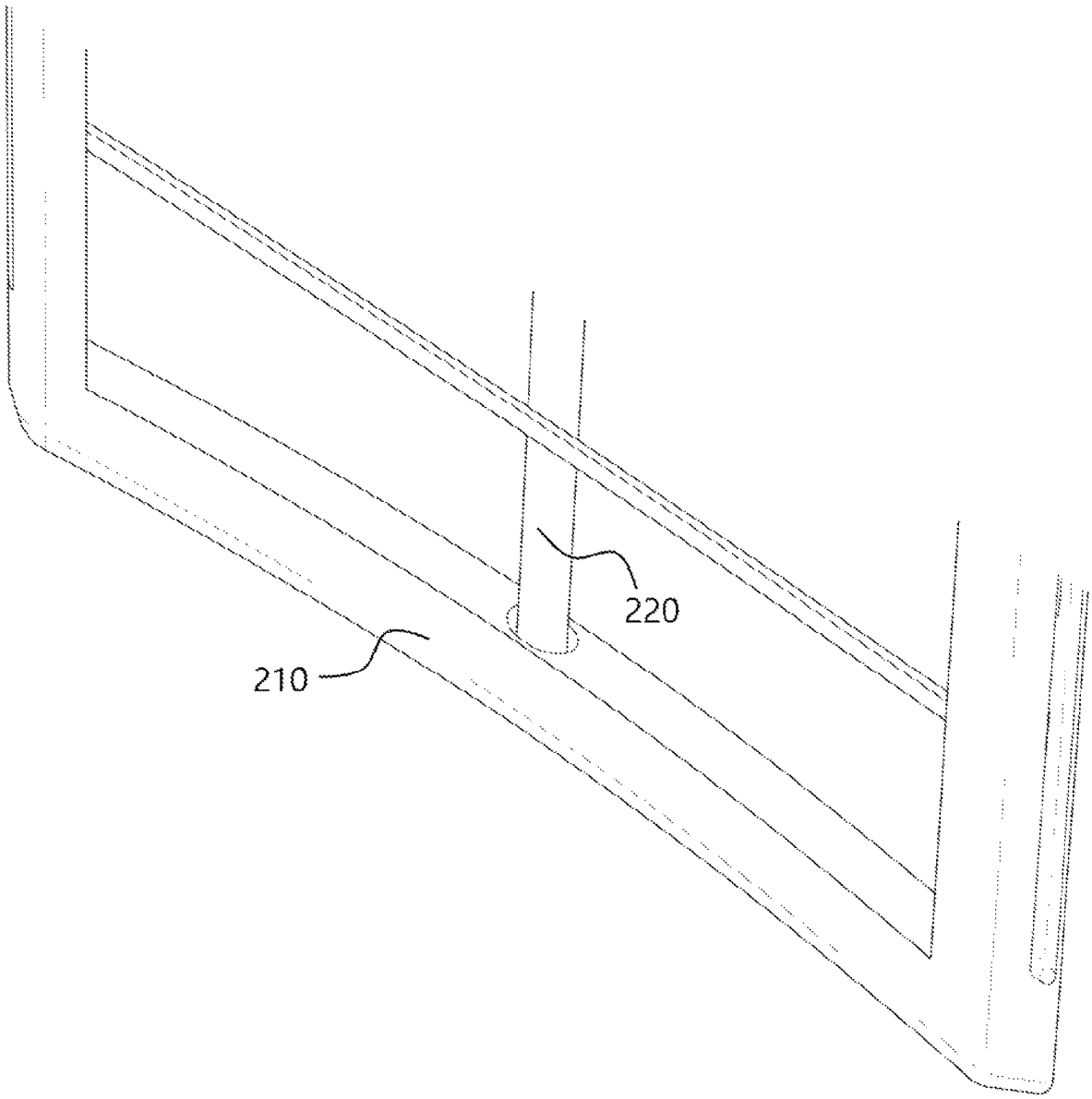
FIG. 6*b* is an enlarged view for explaining movement of a pole that can change an angle of the waist depending on a user's sitting posture in the chair backboard shown in FIG. 5.

FIG. 6*b* is an enlarged view for explaining movement of a pole that can change an angle of the waist depending on the user's sitting posture in the chair backboard 200 shown in FIG. 5. According to the present invention, the chair backboard 200, more specifically the upper and lower backboard frames (251, 252), is characterized by being capable of moving up and down depending on the user's sitting posture, which has, for example, a principle that the entire upper and lower backboard frames (251, 252) move like a seesaw by adding a function of rotation to both edges of the chair backboard 200 and fixing the pole 220.

As shown in FIG. 6*b*, grooves formed on the upper and lower portions of the border frame 210 to which the pole 220 is coupled may be made slightly wider than the diameter of the pole 220 to ensure the movement of the pole 220. Accordingly, since the pole 220 moves depending on to the user's posture, the user's waist angle can also be changed adaptively.

More specifically, (1) when the user takes the forward leaning posture, the waist bone is directed backward so that the user's back does not come into contact with the chair backboard 200, and if the concept of a seesaw is applied thereto, the upper backboard frame 251 can come out toward the front naturally while a waist bone supporter is pushed by the weight of the user, (2) when the user takes the normal posture, the basic posture of the user is maintained while the waist supporter becomes horizontal, and (3) when the user takes the backward leaning posture, the user's back is relatively more tilted backward so that the portion of the waist bone protrudes forward the front contrary to the tilted posture, whereby the user's posture can be maintained without any change even if a lower site of the waist is not floating or falling below.

Figure 7:
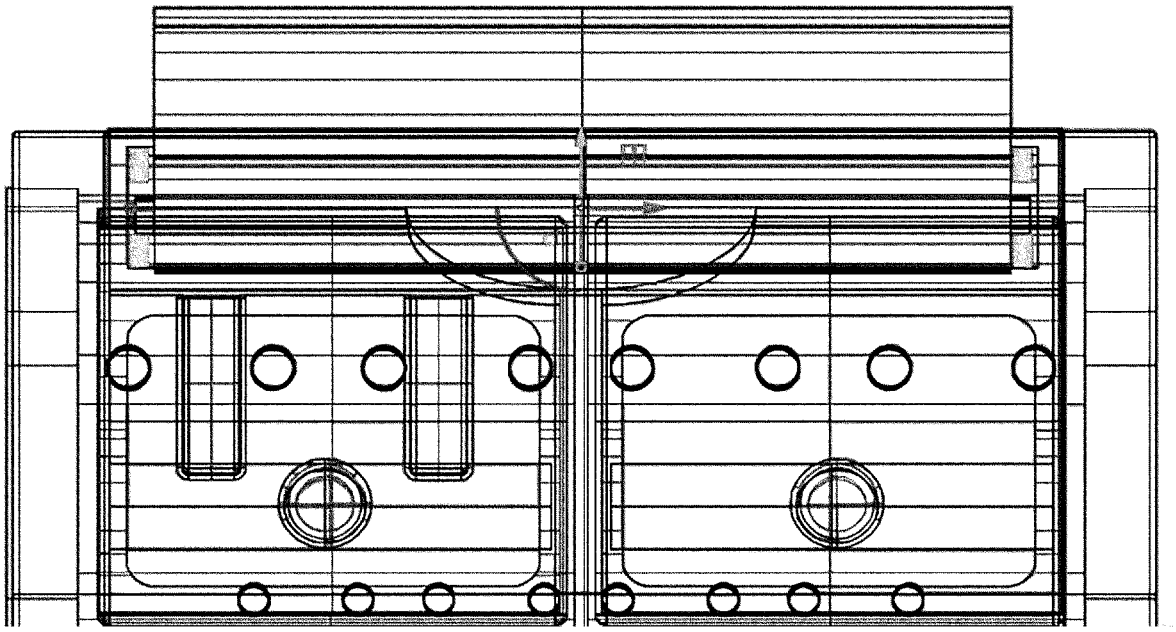
FIG. 7 is an internal cross-section view of a limiting plate according to an embodiment of the present invention.
Figure 8:
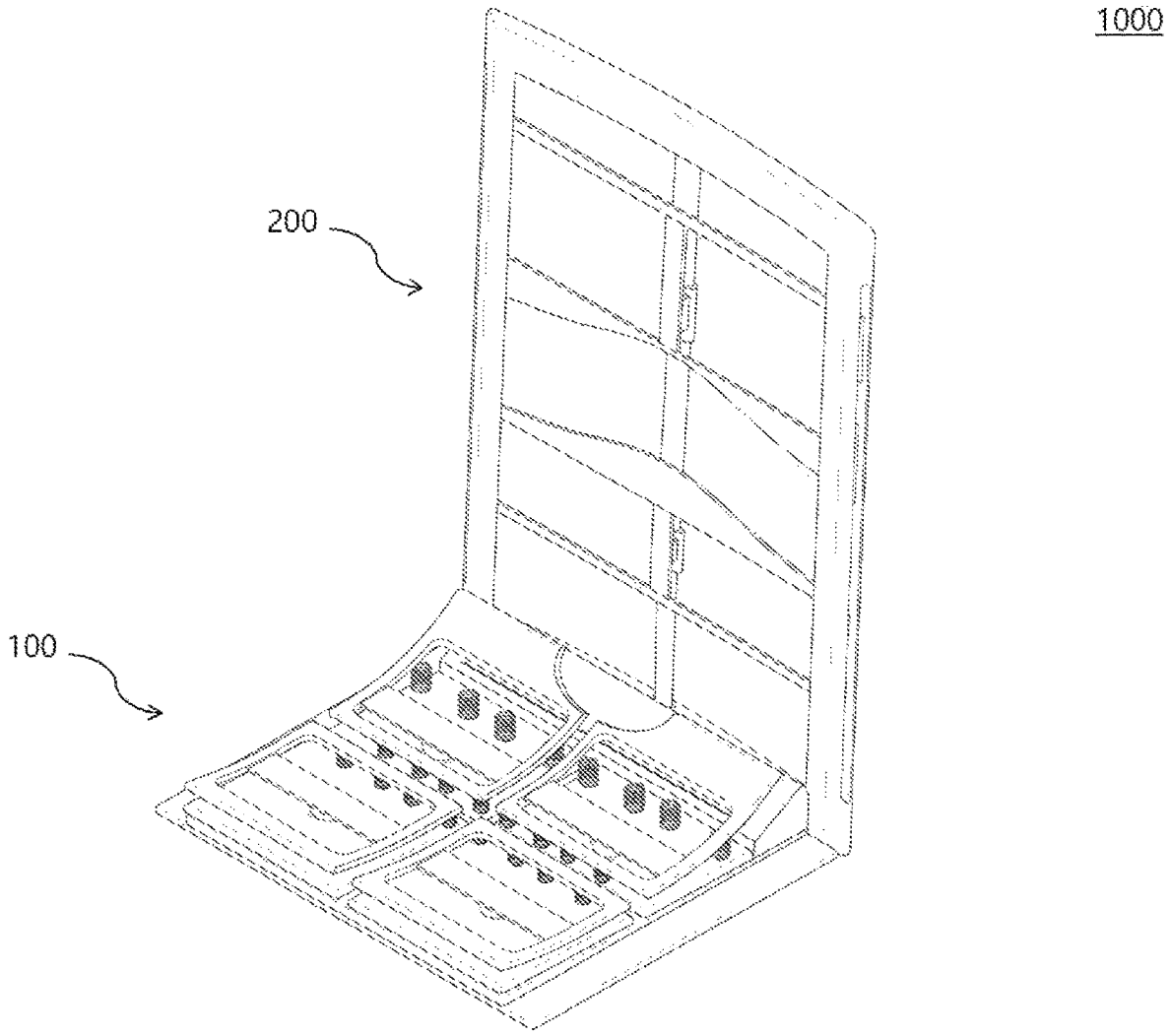
FIG. 8 is a conceptual diagram of a chair having a chair seat board and a chair backboard combined with each other according to an embodiment of the present invention.

FIG. 7 is an internal cross-section view of a limiting plate 22 according to an embodiment of the present invention, and FIG. 8 is a conceptual diagram of a chair 1000 having a chair seat board 100 and a chair backboard 200 combined with each other according to an embodiment of the present invention.

As shown in FIG. 8, the chair 1000 according to an embodiment of the present invention may be composed of the chair seat board 100 and the chair backboard 200 combined to one side of the chair seat board 100, wherein the combination of the chair seat board 100 and the chair backboard 200 can be implemented by the limiting plate 22 formed on one side of the support unit of the chair seat board 100 (more specifically disposed on one side of an upper surface of the second central support plate 21), in particular by a rectangular groove 22-1 formed on one side of the limiting plate 22.

As shown in FIG. 7, a connection plate for interconnecting the chair seat board 100 and the chair backboard 200 may be provided inside the limiting plate 22, and a groove dug such that the connection plate can move, and a spring inside the groove may be additionally provided.

As described above, by virtue of the chair seat board and the chair comprising the same according to an embodiment of the present invention, an optimal angle of 125 degrees to 135 degrees can be provided to minimize burden on the waist that may cause pain due to a gravity when the user is seated.

Further, by virtue of to the chair seat board and the chair comprising the same according to an embodiment of the present invention, a comfort to the extent that the user does not feel any interference when seated can be provided by combining omnidirectional movement of the central sphere in the recess and flexible movement of the plurality of frames relative to the spring groups to realize independent movement of the plurality of frames.

Further, by virtue of the chair seat board and the chair comprising the same according to an embodiment of the present invention, the user's waist can be maintained in the neutral posture to prevent excessive bending of the waist, by implementing a tilt that decreases toward a direction of the hips of the seat board in configuration of the support unit for supporting the plurality of frames realized to allow independent movement on the lower side thereof.

Further, by virtue of the chair seat board and the chair comprising the same according to an embodiment of the present invention, the sciatic balance and the weight distribution can be maximized by arranging the central plate in the area corresponding to the sciatic site and making a strength of the area corresponding to a user's sciatic site greater than that of the other areas in implementing the memory foam that covers the frames.

Further, by virtue of the chair comprising the ergonomic backboard according to an embodiment of the present invention, the waist plate can be deformed ergonomically and optimally according to the user's posture by coupling the backboard to one side of the seat board and implementing to move it up and down and left and right depending on the user's sitting posture.

Meanwhile, the various embodiments described herein may be realized by a hardware, a middleware, a microcode, a software, and/or a combination thereof. For example, the various embodiments may be implemented within one or more application specific integrated circuits (ASICs), digital signal processors (DSPs), digital signal processing devices (DSPDs), programmable logic devices (PLDs), field programmable gate arrays (FPGAs), processors, controllers, microcontrollers, microprocessors, other electronic units designed to perform the functions presented herein, or a combination thereof.

Further, for example, the various embodiments may be embodied or encoded on a computer-readable medium containing instructions. The instructions embodied or encoded on the computer-readable medium may cause a programmable processor or the other processor to perform a method, e.g., when the instructions are executed. The computer-readable medium may include a computer storage medium, and the computer storage medium may be any available medium that can be accessed by a computer. For example, such a computer-readable medium may include RAM, ROM, EEPROM, CD-ROM or other optical disk storage medium, magnetic disk storage medium, or other magnetic storage device.

Such hardware, software, firmware, etc. may be implemented within the same device or within separate devices to support the various operations and functions described herein. Additionally, constitutive elements, units, modules, components, and the like, described as "units" or "portion" in the present invention may be implemented together or separately as interoperable logic devices. The description of different features for modules, units, etc. is intended to highlight different functional embodiments and does not necessarily imply that they must be realized by separate hardware or software components. Rather, functionality associated with one or more modules or units may be performed by separate hardware or software components or integrated within common or separate hardware or software components.

Although the operations are shown in a specific order by the drawings, it should not be understood that these operations are performed in the specific order as shown or in a sequential order or that all illustrated operations need to be performed to achieve the desired result. Under a certain environment, multitasking and parallel processing may be advantageous. Moreover, the division of various constitutive elements in the above-described embodiments should not be understood as requiring such division in all embodiments, and it should be understood that the constitutive elements as described may be generally integrated together into a single software product or packaged into multiple software products.

As described above, the optimal embodiments have been disclosed in the drawings and the specifications. Although specific terms have been described herein, these terms are used only for the purpose of explaining the present invention, and are not used to limit the meaning or scope of the present invention described in the claims. Therefore, a person who has an ordinary knowledge in the art will understand that various modifications and other embodiments equivalent thereto can be performed therefrom. Therefore, the true technical scope of the present invention should be determined by the technical spirit of the appended claims.

DESCRIPTION OF REFERENCE NUMERALS

10: First support plate
11: First central plate
12-1: First side support plate
12-2: Second side support plate
20: Second support plate
21: Second central support plate
22: Limiting plate
22-1: Rectangular groove
30: Third support plate
31: Left leg support plate
31-1: First spring group
31-2: Second spring group
31-3: First recess
32: Right leg support plate
33: Left hip support plate
33-1: Third spring group
33-2: Fourth spring group
33-3: Second recess
34: Right hip support plate
40: Frame unit
41: First leg frame
41-1: Frame border
41-2: First central plate
41-3: First central sphere
42: Second leg frame
43: First hip frame
43-1: Frame border
43-2: Second central plate
43-3: Second central sphere
43-4: Cutout portion
44: Second hip frame
50: Memory foam
51: First leg memory foam
52: Second leg memory foam
53: First hip memory foam
54: Second hip memory foam
100: Chair seat board
110: A pair of leg seat boards
111: First leg seat board
112: Second leg seat board
120: A pair of hip seat boards
121: First hip seat board
122: Second hip seat board
130: A pair of side seat boards
131: First side seat board
132: Second side seat board
200: chair backboard
210: Border frame
211: Side groove
220: Pole
230: Backboard memory foam
231: Upper backboard memory foam
232: Lower backboard memory foam
240: Third central plate
241: Rotation axis
251: Upper backboard frame
252: Lower backboard frame What are claimed are:

1. A chair seat board (100) comprising:

a frame unit (40) having a plurality of frames (41, 42, 43, 44) configured in a hollow shape, respectively, and implemented to allow independent movement; and a support unit configured to support the frame unit (40) while being coupled to the frame unit (40) on a lower side of the frame unit (40), wherein the support unit includes a first support plate (10) consisting of a first central support plate (11) and side support plates (12-1, 12-2) disposed on both sides of the first central support plate (11); a second support plate (20) coupled to an upper portion of the first support plate (10) and consisting of a second central support plate (21) and a limiting plate (22) disposed on an upper surface of one side of the second central support plate (21); and a third support plate (30) coupled to an upper portion of the second support plate (20) and consisting of a plurality of leg support plates (31, 32) and a plurality of hip support plates (33, 34) formed to correspond to the plurality of frames (41, 42, 43, 44).

2. The chair seat board (100) according to claim 1, wherein a thickness of the second central support plate (21) is implemented to increase as it progresses from one side on which the limiting plate (22) is disposed to a side of the second central support plate opposite the limiting plate.

3. The chair seat board (100) according to claim 1, wherein each of the plurality of leg support plates (31, 32) and the plurality of hip support plates (33.34) is provided with recesses (31-3, 33-3) on at least some areas, and each of the plurality of frames (41.42, 43, 44) is provided with central plates (41-2, 43-2) having central spheres (41-3, 43-3) coupled to at least some areas of a lower surface.

4. The chair seat board (100) according to claim 3, wherein the central spheres (41-3, 43-3) coupled to the central plates (41-2, 43-2) are accommodated in the recesses (31-3, 33-3), so that a coupling between the third support plate (30) and the frame unit (40) is implemented.

5. The chair seat board (100) according to claim 4, wherein the plurality of leg support plates (31, 32) and the plurality of hip support plates (33, 34) are provided with a plurality of spring groups (31-1, 31-2, 33-1, 33-2) arranged to correspond to at least some areas of borders of the plurality of frames (41, 42, 43, 44), and wherein omnidirectional movement of the central spheres (41-3, 43-3) in the recesses (31-3, 33-3) and flexible movement of the plurality of frames (41, 42, 43, 44) relative to the spring groups (31-1, 31-2, 33-1, 33-2) are combined with each other to achieve independent movement of the plurality of frames (41, 42, 43, 44).

6. The chair seat board (100) according to claim 1, further comprising a memory foam (50) configured to cover the frame unit (40) coupled to the support unit.

7. The chair seat board (100) according to claim 6, wherein the memory foam (50) is composed of a plurality of leg memory foams (51, 52) and a plurality of hip memory foams (53, 54) configured to correspond to the plurality of leg support plates (31, 32) and the plurality of hip support plates (33, 34), wherein the plurality of hip memory foams (53, 54) are implemented such that a strength of the area corresponding to a sciatic or sit-bone site is greater than that of the other areas.

8. The chair seat hoard (100) according to claim 7, wherein the plurality of leg memory foams (51, 52) are implemented such that a strength of a front-end part thereof is less than that of the plurality of hip memory foams (53, 54), and wherein an end of the front-end part of the plurality of leg memory foams (51, 52) is formed to bend downward.

9. A chair (1000) comprising: the chair seat board (100) according to claim 1: and a chair backboard (200) coupled to one side of the chair seat board (100).

* * * * *